United States Patent [19]

Kono et al.

[11] Patent Number: 4,775,511

[45] Date of Patent: Oct. 4, 1988

[54] METHOD OF SULFIDE TARNISH INHIBITING OF SILVER-COPPER, SILVER-GOLD AND SILVER-COPPER-GOLD ALLOYS

[76] Inventors: William Kono, 4 MacDonald Cir. #2, Albany, N.Y. 12204; John P. Nielsen, 1 Washington Square Village, New York, N.Y. 10012

[21] Appl. No.: 883,364

[22] Filed: Jul. 8, 1986

[51] Int. Cl.[4] ..... C22C 5/06; C22C 5/08

[52] U.S. Cl. ..... 420/502; 420/503; 420/505

[58] Field of Search ..... 420/501, 502, 503, 504, 420/505, 506

[56] References Cited

U.S. PATENT DOCUMENTS

| | | | |
|---|---|---|---|
| 1,024,476 | 4/1912 | Rossi | 420/501 |
| 1,952,082 | 3/1934 | Leach | 420/501 |
| 2,046,056 | 6/1936 | Bremer | 420/501 |
| 2,161,576 | 6/1939 | Hensel et al. | 420/501 |
| 2,195,307 | 3/1940 | Hensel et al. | 420/501 |
| 2,196,307 | 4/1940 | Hensel et al. | 420/501 |
| 4,448,605 | 5/1984 | Mizuhara | 420/501 |
| 4,591,535 | 5/1986 | Mizuhara | 428/627 |

FOREIGN PATENT DOCUMENTS

| | | | |
|---|---|---|---|
| 135603 | 4/1985 | European Pat. Off. . | |
| 49674 | 12/1972 | Japan | 420/501 |
| 26889 | 8/1976 | Japan | 420/501 |
| 221206 | 12/1983 | Japan . | |
| 162741 | 8/1985 | Japan | 420/501 |
| 425958 | 4/1974 | U.S.S.R. | 420/501 |
| 435296 | 7/1974 | U.S.S.R. | 420/501 |
| 399261 | 10/1933 | United Kingdom | 420/501 |
| 410683 | 5/1934 | United Kingdom | 420/501 |

OTHER PUBLICATIONS

Kazuo, "Silver Alloys for Electric Contacts", Chem. Absts., 105:47442, vol. 105, 1986, p. 285.

Susumu, "Sliding Electric Contact Materials", Chem. Absts., 105:157440, vol. 105, 1986, p. 282.

Pawlowski, "Kinetics of Oxidation of Silver Alloys Containing Copper, Aluminum and Magnesium Additions", Chem. Absts. 95:66340, vol. 95, 1981, p. 267.

Dukiet-Zawadzka et al., "Dendritic Segregation of Silver-Copper Alloys with Additions of Titanium, Aluminum, Magnesium and Nickel", Chem. Absts. 96:127952, vol. 96, 1982, p. 338.

Pelczynski et al. "Hard Silver Alloy", Chem. Absts. 97:42732, vol. 97, 1982, p. 235.

Tanaka Noble Metal, "Sliding Electric Contact Silver Alloys", Chem. Absts. 99:162672, vol. 99, 1983, p. 257.

Hansen, *Constitution of Binary Alloys,* McGraw-Hill, 1958, p. 55.

*Primary Examiner*—L. DeWayne Rutledge
*Assistant Examiner*—Robert L. McDowell
*Attorney, Agent, or Firm*—Ilya Zborovsky

[57] ABSTRACT

Sulfide tarnish inhibiting of silver base alloys selected from the group consisting of Ag-Cu, Ag-Au, and Ag-Cu-Au is achieved by adding to silver base alloys at least one element with passivating ability and with heat of sulfide formation which exceeds the heat of sulfide formation of silver and in the amount which does not exceed 1.5 weight % as substitute of silver, so as to form a thin layer of oxide of the element which is selected from the group consisting of Cr, Ta, Al, Ti and Th. The layer of oxide is thin and does not affect the properties of silver base alloys. The added element, in the event of damage to the oxide layer, forms a sulfide film of the element before formation of silver sulfide, to thereby protect silver base alloys from tarnishing.

2 Claims, No Drawings

METHOD OF SULFIDE TARNISH INHIBITING OF SILVER-COPPER, SILVER-GOLD AND SILVER-COPPER-GOLD ALLOYS

BACKGROUND OF THE INVENTION

The present invention relates to a method of sulfide tarnish inhibiting of silver alloys, as well as to silver alloys which are treated in accordance with the above method.

It is well known that chemical stability and in particular corrossion stability of silver is the main factor why it is widely used for manufacture of equipment parts in chemical industry, and also an important factor of its use in many other fields. For example, only its chemical stability explains the wide usage of silver for making mirrors, coins, silverware, bearing, electrical contacts, as well as its usage in jewelry and dentistry. Corrosion stability of silver can be explained mainly by its position in the row of potentials. To smaller extent, it is also a result of its ability to form a protective film of oxide ($Ag_2O$) which, however, is not dense and stable enough, and has a porosity.

At the same time, it is well known that silver is not stable in presence of hydrogen sulfide ($H_2S$) and other sulfide components even in small concentrations. The surface of silver very quickly covers with a film of silver sulfide ($Ag_2S$). The initially light color of film becomes darker and soon turns dark, then greenish-brown, and finally black. The rate of tarnishing of silver-copper alloys increases with greater copper content, because in addition to silver sulfide, black copper sulfide ($Cu_2S$) is also formed. The rate of tarnishing of silver and silver alloys accelerates with increasing in humidity of air and concentration of sulfur compounds.

Sulfide film can be removed from the surface by a chemical treatment, by polishing, or their combination. To prevent tarnishing, it is possible to cover the surfaces of silver products by film of other stable metals, such as Rhodium, by film of oxides of Aluminum, Beryllium, Technetium and Zirconium, or by cathodic passivation in salts of Chromium and other metals. These methods can increase the tarnish resistance of silver up to five times. However, it was found that main disadvantage of those methods is that any accidental scratch will expose the fresh silver surface and therefore initiate the tarnishing process.

There have been a lot of attempts to produce a "stainless" silver alloy. They, however, failed since they involved adding of another metal in big quantities. The problem is that such addition of big quantities of metal simultaneously changes the karat composition, appearance and properties of silver.

SUMMARY OF THE INVENTION

Accordingly, it is an object of the present invention to provide a method of sulfide tarnish inhibiting for silver alloys, which avoid the disadvantages of the prior art.

More particularly, it is an object of the present invention to provide such a method, which guarantees effective sulfide tarnish inhibiting for silver alloys, and at the same time does not change karat composition, appearance, and properties of silver alloys.

It is also an object of the present invention to provide silver alloys, which are produced (treated) in correspondence with the inventive method, and therefore exhibit sufide tarnish inhibiting properties.

In keeping with these objects and with others which will become apparent hereinafter, one feature of the present invention resides, briefly stated, in a method of sulfide tarnish inhibiting of silver alloys, in accordance with which at least one element with the heat of sulfide formation higher that the heat of sulfide formation of silver is added to silver alloy selected from the group consisting of silver-copper alloys, silver-gold alloys and silver-copper-gold alloys in the amount which does not exceed 1.5 weight % as substitute of silver, so as to form on silver or alloy an oxide layer of this element, so that even if for any reason the oxide layer is damaged, this element forms a sulfide film before formation of silver sulfide and thereby protects silver alloy from tarnishing.

The oxide layer produced in accordance with the inventive method is thin, stable and non-porous. For example, Aluminum forms a film of oxide, which is 2–5 nm thick, dense and uniform. Any accidental scratch, breakage etc. does not affect silver alloy, since a new oxide film develops immediately. The effectiveness of addition increases with increase of heat of sulfide formation of the corresponding element. For example, Aluminum with heat of sulfide formation equal to 724 kj/mol is more effective than Titanium with 269 kj/mol. The quantity of the element added to silver alloy in accordance with the inventive method is inversely proportional to its heat of sulfide formation. The higher is the heat of sulfide formation of the element, the smaller quantity of it can be added to silver alloy, to impart to the latter sulfide tarnish inhibiting properties.

The small amount of addition of the element does not change significantly the properties of silver alloys. As mentioned hereinabove, the elements which are added to silver alloys must have the heat of formation higher than the heat of formation of silver sulfide which is 31.8 kj/mol, and preferably is higher than 200 kj/mol. The elements to be added include Cr, Ta Al, Ti, Th. As mentioned hereinabove, the elements are added in a very small amount which does not exceed 1.5% as substitute of silver. In unexpected and surprising manner it was found that the addition of the above very small amount of the above elements (not higher than 1.5 weight %, and sometimes as much as 0.4 weight % as substitute of silver) not only does not significantly change the composition, appearance and other properties of silver alloys, but results in the formation of the above thin oxide layer of the respective element, possessing high tarnish-resistant properties, stable and non-porous and thereby reliably inhibiting sulfide tarnish of silver alloys.

There is the question of weight % vs atomic % in the additions of the inhibiting elements. It is known that tarnish behavior and its inhibition is a chemical phenomenon, and therefore the atomic %, or molar % is more precise method of evaluating the amounts of additions to be made. Here the weight % is used throughout, but is should be recognized that for light or very heavy atomic weight elements, corrections between atomic % and weight % might be advisable.

The novel features of the present invention are set forth in particular in the appended claims. The invention itself, however, will be best understood from the following description of preferred embodiments of the present invention, both as to the inventive method and the compositions produced thereby.

DESCRIPTION OF PREFERRED EMBODIMENTS

In accordance with the present invention, a method of sulfide tarnish inhibiting is proposed for silver alloys, as well as silver alloys treated by the new method. The silver alloys in question are silver-gold alloys, silver-copper alloys and silver-copper-gold alloys.

The inventive method consists in adding to silver alloy, a very small amount of an element or elements with heat of sulfide formation higher than the heat of sulfide formation of silver (31.8 kg/mol). Preferably, such elements are advisable to be added whose heat of sulfide formation exceeds 200 kj/mol. The above elements include Cr, Ta, Al, Ti, Th. These elements have passivating ability. The amount of the elements must not exceed 1.5 weight % as substitute of silver. The amount of the elements added is inversely proportional to its heat of sulfide formation. The higher is the heat of sulfide formation of an element, the smaller amount of its must be added to silver alloy. At the same time, the heavier is the respective element, the more weight % of it just be added.

When the above additives are added to the above alloys in the amount which does not exceed 1.5 weight %, an oxide layer of these elements is formed on the surface of silver alloy. The layer is very thin, it does not affect the properties of silver alloy, and does not even change the color of the latter. At the same time, it is stable, non-porous and reliably renders silver alloy, sulfide tarnish resistant properties. In the event of accidental damage to the above oxide film, the added element immediately forms a film of sulfide of this element, before formation of silver sulfide, and thereby protects silver alloy.

Tarnish resistance of silver alloys treated in accordance with the inventive method, and not treated silver alloys, was determined by a Tuccillo-Nielsen tarnish-tester, see Tuccillo-Nielsen, "Observation of Onset of Sulfide Tarnish on Gold Base Alloys", J. Prosthetic Dentistry, 25, 629–637 (1971)

The materials for testing were melted in a graphite cricuble in an electric resistance furnace, bench cooled, and then subjected to tarnish in 0.005 weight % sodium sulfide solution. The tests results showed a considerable increase in tarnish resistance in silver alloys treated in accordance with the present invention with the above additives, over the silver alloys which have not been treated or in other words not provided with the above additives. For example, after 15 min. tests, ordinary sterling silver was black, while the same sterling silver with 0.5 weight % of Al. stayed intact. It turned black only after 3 hours of testing, thus indicating 12 times increase in sulfide tarnish stability.

It should be emphasized again that the smallness of the amount of additives is critical for the present invention. If the amount of additives exceeds 1.5 weight %, the sulfide tarnish inhibiting properties are no longer exhibited. The above small amount of the additives is a core of the present invention, it is unexpected, unobvious, and provides for highly advantageous results.

As shown hereinabove, the inventive method provides effective sufide tarnish resistant passivation of silver alloys. The preferable additives to silver-copper alloys are Al and Cr of about 0.5 weight %, for gold-silver and gold-silver-copper alloys is Cr of about 0.4 weight %. The same 10–12 times increase in sulfide tarnish inhibiting for silver alloys was achieved by adding 0.75 % of Ti, 1.25 % of Th, and 1.5 % of Ta.

The invention is not limited to the details shown since various modifications and structural changes are possible without departing in any way from the spirit of the present invention.

What is desired to be protected by Letters Patent is set forth in particular in the appended claims presented hereinabove.

We claim:

1. A method of sulfide tarnish inhibiting for silver base alloys selected from the group consisting of silver-copper alloys, silver-gold alloys and silver-copper-gold alloys, comprising adding to silver base alloys selected from the group consisting of silver-copper alloys, silver-gold alloys and silver-copper-gold alloys at least one element with passivating ability and with heat of sulfide formation which exceeds the heat of sulfide formation of silver and selected from the group consisting of Cr, Ta, Al, Ti and Th and in the amount which does not exceed 1.5 weight % as substitute of silver, so as to form a thin layer of oxide of said at least one element, the layer being stable and not affecting properties of silver base alloys, and said at least one element forming in the event of damage to said layer of oxide, a sulfide film of said element before formation of silver sulfide so as to thereby protect silver base alloys from tarnishing.

2. A silver base alloy selected from the group consisting of silver-copper alloys, silver-gold alloys, and silver-copper-gold alloys, comprising at least one element with passivating ability and with heat of sulfide formation which exceeds the heat of sulfide formation of silver and selected from the group consisting of Cr, Ta, and Th, and in the amount which does not exceeds 1.5 weight % as substitute of silver, so as to form a thin layer of oxide of said at least one element, the layer being stable and not affecting properties of the silver base alloy, and said at least one element in the event of damage to said layer of oxide forming a sulfide film of said element before formation of silver sulfide, so as to thereby prevent silver tarnishing of said silver base alloys.

* * * * *